US010370810B1

(12) United States Patent
Times

(10) Patent No.: US 10,370,810 B1
(45) Date of Patent: Aug. 6, 2019

(54) FECES COLLECTION ASSEMBLY

(71) Applicant: Edward Times, Vacaville, CA (US)

(72) Inventor: Edward Times, Vacaville, CA (US)

( * ) Notice: Subject to any disclaimer, the term of this patent is extended or adjusted under 35 U.S.C. 154(b) by 0 days.

(21) Appl. No.: 16/149,119

(22) Filed: Oct. 1, 2018

(51) Int. Cl.
*E01H 1/12* (2006.01)

(52) U.S. Cl.
CPC ..... *E01H 1/1206* (2013.01); *E01H 2001/128* (2013.01); *E01H 2001/1293* (2013.01)

(58) Field of Classification Search
CPC ..... E01H 1/1206; E01H 2001/122; E01H 2001/1226; E01H 2001/128; E01H 2001/1293
USPC ..... 294/1.4
See application file for complete search history.

(56) References Cited

U.S. PATENT DOCUMENTS 3,194,597 A * 7/1965 Lasch, Jr. ..... B25J 1/04 15/257.6
4,248,468 A * 2/1981 Hastings ..... E01H 1/1206 294/1.4
4,878,703 A 11/1989 Yoshioka
D368,003 S 3/1996 Simon
5,503,442 A * 4/1996 Lee ..... E01H 1/1206 294/1.4
7,992,907 B1 8/2011 DeJesus
8,550,512 B2 10/2013 Jones, Jr.
8,714,604 B1 * 5/2014 Mihalic ..... E01H 1/1206 294/1.4
8,733,808 B2 * 5/2014 Andersen ..... A01K 29/00 294/1.4
8,998,279 B2 4/2015 Lloyd
9,091,031 B2 * 7/2015 Naseem ..... E01H 1/1206
D802,229 S * 11/2017 Rouayroux ..... D30/162
2008/0136201 A1 * 6/2008 Dong ..... E01H 1/1206 294/1.3
2008/0265592 A1 10/2008 Askinasi
2009/0261603 A1 * 10/2009 Boghozian ..... E01H 1/1206 294/1.3
2016/0153158 A1 * 6/2016 Karius ..... E01H 1/1206 294/1.4

FOREIGN PATENT DOCUMENTS

FR 2803311 A1 * 7/2001 ..... E01H 1/1206
WO WO2006083255 8/2006
WO WO-2008033166 A1 * 3/2008 ..... E01H 1/1206

* cited by examiner

*Primary Examiner* — Dean J Kramer

(57) ABSTRACT

A feces collection assembly includes a handle. The handle is elongated thereby facilitating the handle to extend to ground when the handle is gripped. A grip is attached to the handle for enhancing gripping the handle and a ring is movably positioned on the grip. The ring is urgeable between an opening position and a closing position. A pair of jaws is each movably positioned on the handle to manipulate feces on the ground. Each of the jaws is operationally coupled to the ring, and the pair of jaws opens and closes when the ring is urged between the opening and closing positions. Thus, the jaws can be positioned around the feces and subsequently close beneath the feces. A plurality of bags is provided and a selected one of the bags is wrapped around the jaws to capture the feces when the jaws are closed around the feces.

6 Claims, 5 Drawing Sheets

FECES COLLECTION ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to collection devices and more particularly pertains to a new collection device for collecting and bagging animal feces.

BRIEF SUMMARY OF THE INVENTION

An embodiment of the disclosure meets the needs presented above by generally comprising There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
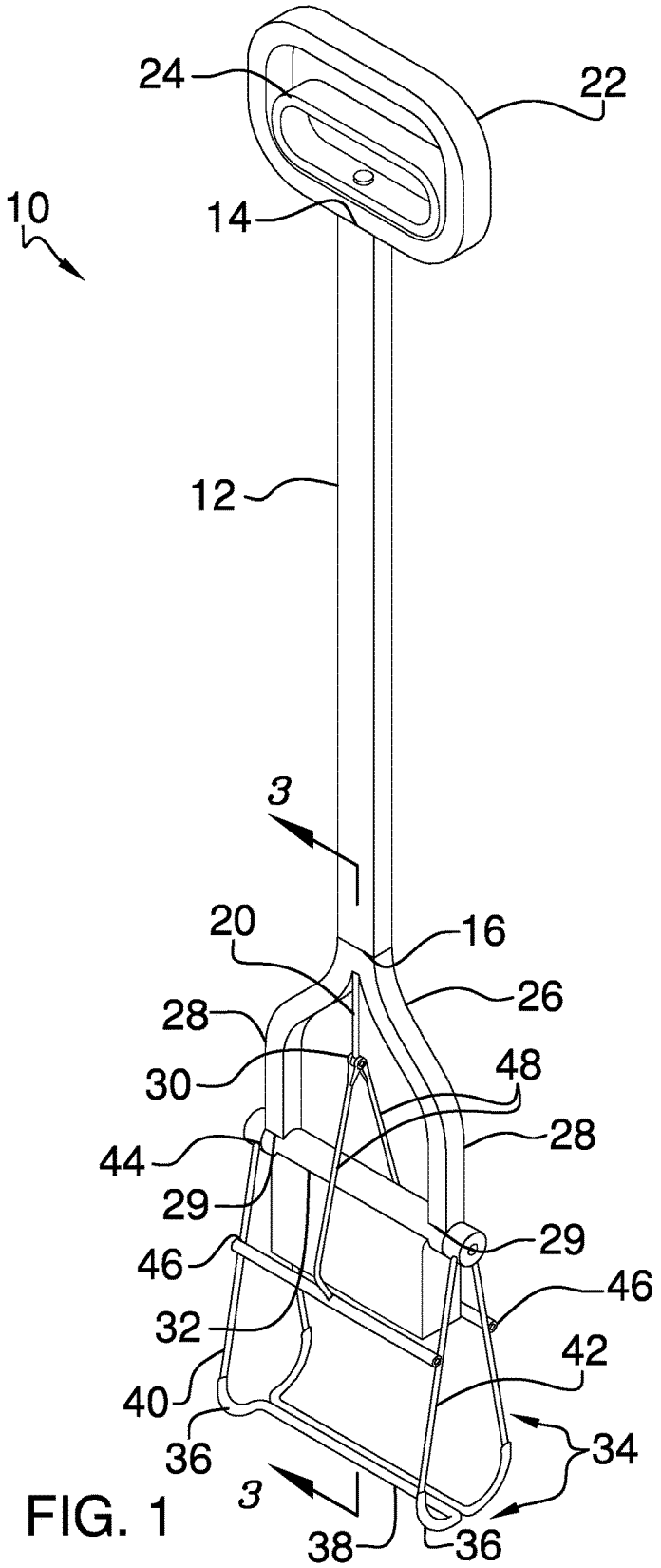
FIG. 1 is a front perspective view of a feces collection assembly according to an embodiment of the disclosure.
Figure 2:
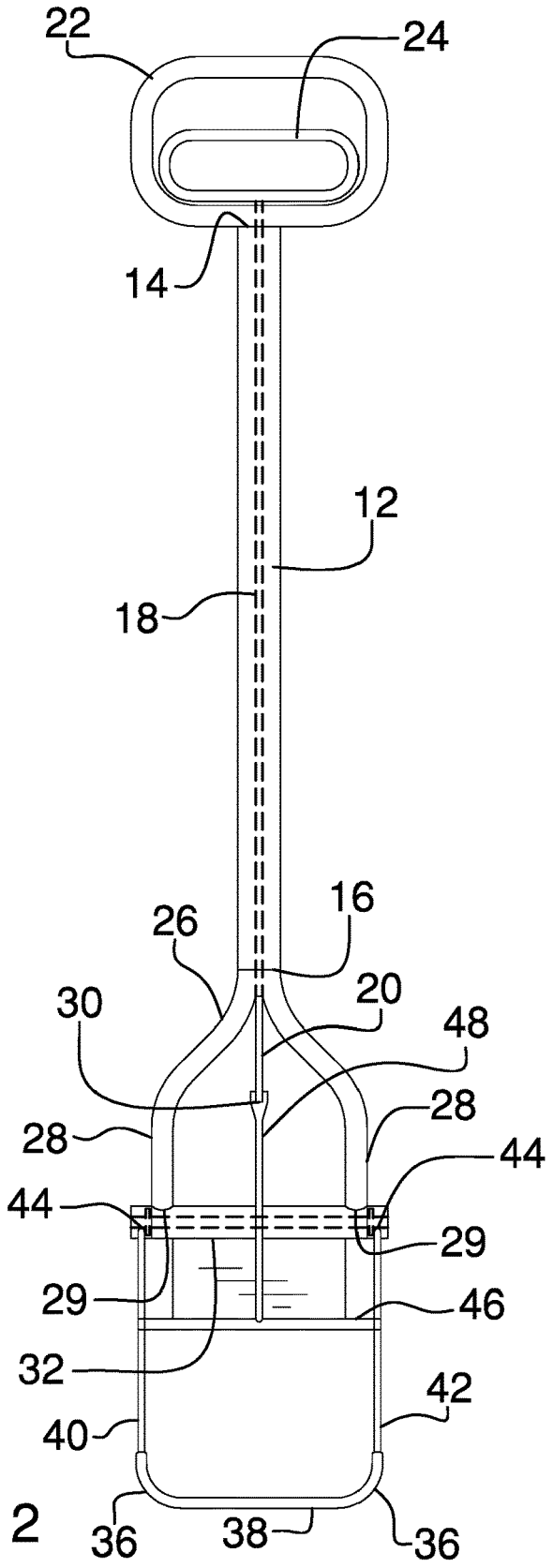
FIG. 2 is a back phantom view of an embodiment of the disclosure.
Figure 3:
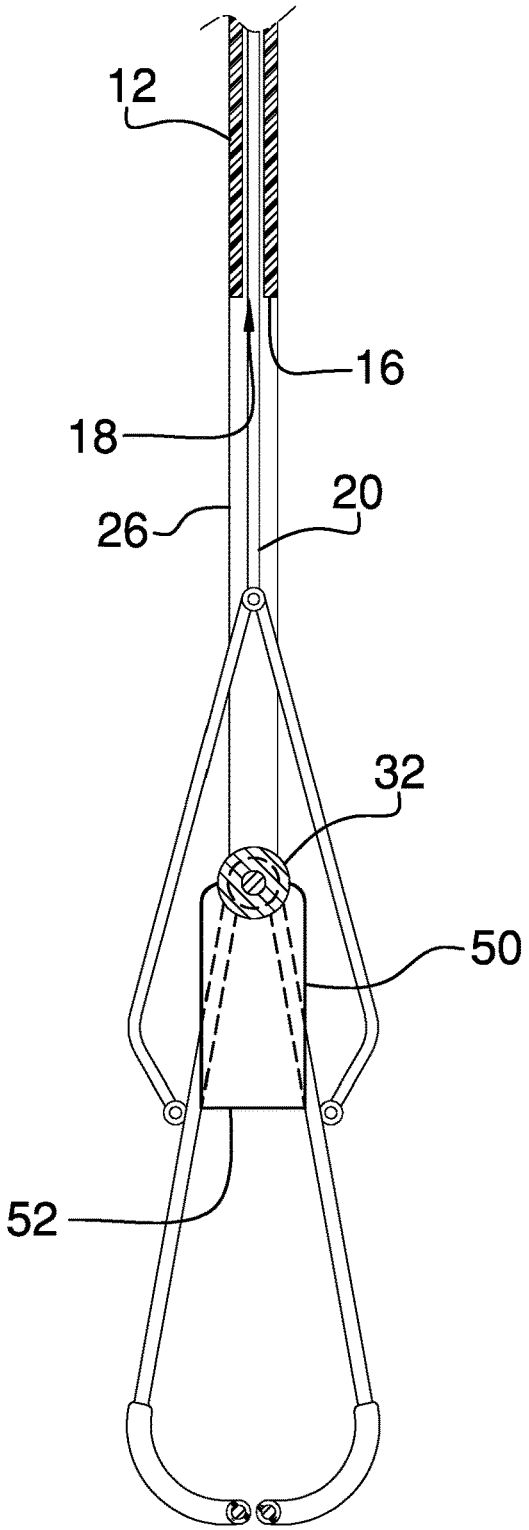
FIG. 3 is a cross sectional view taken along line 3-3 of FIG. 1 of an embodiment of the disclosure showing a pair of jaws in a closed position.
Figure 4:
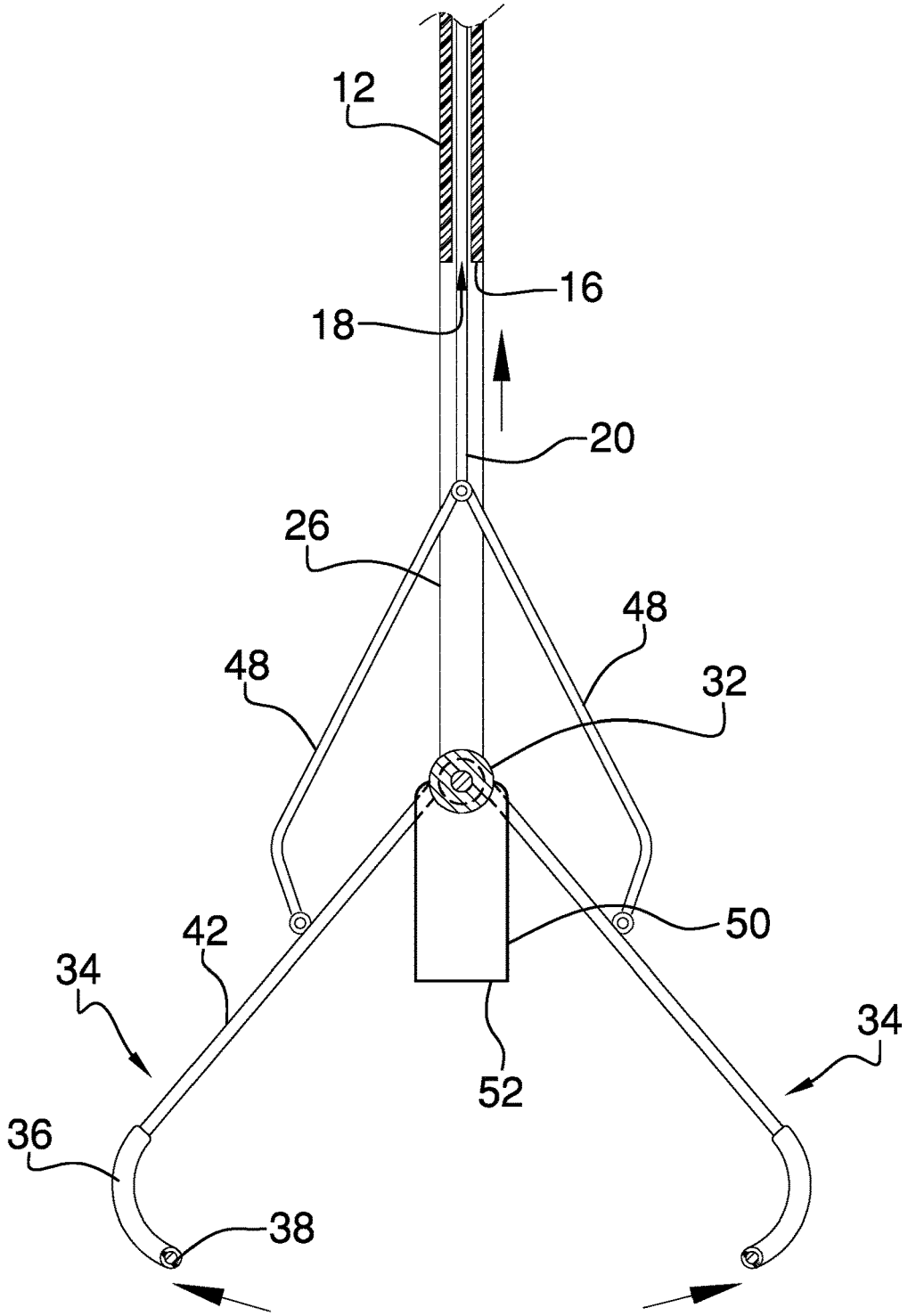
FIG. 4 is a cross sectional view taken along line 3-3 of FIG. 1 of an embodiment of the disclosure showing a pair of jaws in an open position.
Figure 5:
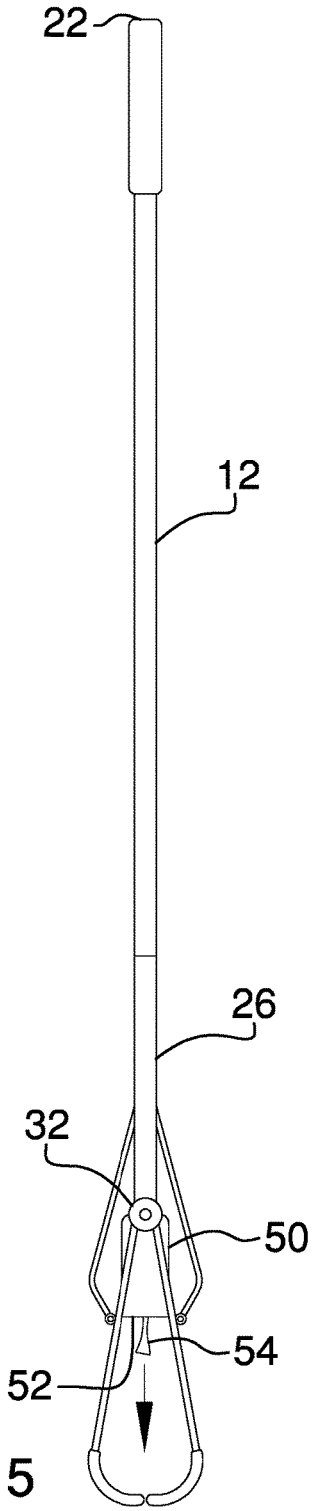
FIG. 5 is a perspective view of an embodiment of the disclosure.
Figure 6:
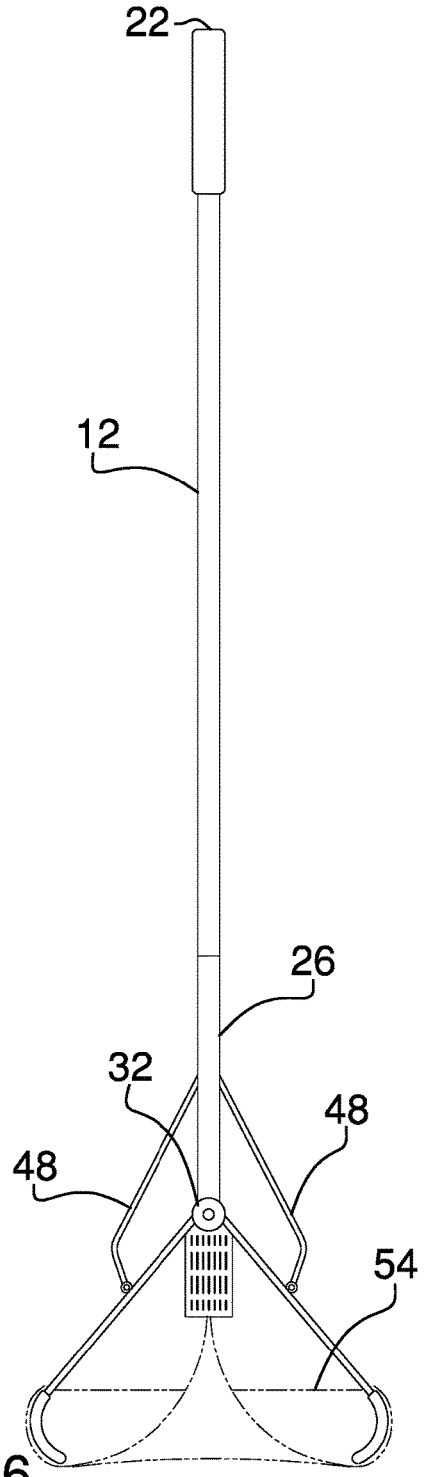
FIG. 6 is a perspective in-use view of an embodiment of the disclosure showing a bag being spread open.

With reference now to the drawings, and in particular to FIGS. 1 through 6 thereof, a new collection device embodying the principles and concepts of an embodiment of the disclosure and generally designated by the reference numeral 10 will be described.

As best illustrated in FIGS. 1 through 6, the feces collection assembly 10 generally comprises a handle 12 for gripping and the handle 12 is elongated thereby facilitating the handle 12 to extend to ground when the handle 12 is gripped. The handle 12 has a first end 14 and a second end 16, and the handle 12 has a conduit 18 extending through the first 14 and second 16 ends. A wire 20 is slidably positioned in the conduit 18 and the wire 20 extends outwardly through each of the first 14 and second 16 ends of the handle 12. A grip 22 is attached to the handle 12 for enhancing gripping the handle 12. The grip 22 is positioned on the first end 14 of the handle 12 and the wire 20 extends through the grip 22. The grip 22 may have a plurality of intersecting members such that the grip 22 forms a closed loop.

A ring 24 is provided and the ring 24 is movably positioned on the grip 22. The ring 24 is urgeable between an opening position and a closing position. Moreover, the wire 20 is coupled to the ring 24 such that the ring 24 urges the wire 20 upwardly in the conduit 18 when the ring 24 is urged into the opening position. The ring 24 may be positioned within the closed loop defined by the grip 22.

A yoke 26 is coupled to the second end 16 of the handle 12. The yoke 26 has a pair of members 28 that are spaced apart from each other and are oriented parallel with an axis extending through the first 14 and second 16 ends of the handle 12. Each of the members 28 has a distal end 29 with respect to the handle 12. Additionally, the wire 20 extends through the yoke 26 and the wire 20 has an exposed end 30 with respect to the yoke 26 that is positioned between the members 28.

A bearing 32 is provided and the bearing 32 is rotatably coupled to the yoke 26. The bearing 32 extends between the distal end 29 of each of the members 28 of the yoke 26. Moreover, the bearing 32 is biased to rotate in a first direction and the bearing 32 is urgeable to rotate in a second direction. The bearing 32 may be an elongated ball bearing or the like and the bearing 32 may be a spring loaded bearing.

A pair of jaws 34 is each movably positioned on the handle 12 for manipulating feces on the ground. The feces may be dog feces resulting from domesticated dogs defecating when the domesticated dog is being walked. Each of the jaws 34 is operationally coupled to the ring 24. Thus, the pair of jaws 34 opens and closes when the ring 24 is urged between the opening and closing positions. In this way the jaws 34 can be positioned around the feces and subsequently close beneath the feces.

Each of the jaws 34 has a pair of bends 36 thereon to define a central portion 38 extending between a first portion 40 and a second portion 42 of the jaws 34. Each of the first 40 and second 42 portions of each of the jaws 34 has a free end 44. Moreover, the free end 44 of each of the first 40 and second 42 portions of each of the jaws 34 is coupled to the bearing 32 having the central portion 38 of each of the jaws 34 being spaced from the bearing 32. The central portion 38 of each of the jaws 34 abuts each other when the bearing 32 is biased to rotate in the first direction. Additionally, the central portion 38 of each of the jaws 34 is spaced apart from each other when the bearing 32 is urged to rotate in the second direction. Each of the first 40 and second 42 portions of each of the jaws 34 has a curve thereon adjacent to the central portion 38 of the jaws 34. Consequently, the first 40 and second 42 portions of each of the jaws 34 angle outwardly from an axis extending through the conduit 18.

A pair of supports 46 is provided and each of the supports 46 is coupled between the first 40 and second 42 portions of a respective one of the jaws 34. Each of the supports 46 is oriented parallel to the central portion 38 of the respective jaw 34. A pair of fingers 48 is each pivotally coupled between the exposed end 30 of the wire 20 and the support on a respective one of the jaws 34. Each of the fingers 48 urges the jaws 34 away from each other when the ring 24 is urged into the opening position. Moreover, the bearing 32 urges each of the jaws 34 toward each other then the ring 24 is released to move in the closing direction.

A box 50 is coupled to the bearing 32 such that the box 50 is positioned between each of the jaws 34. The box 50 has a bottom end 52, the bottom end 52 is open and the bottom end 52 is directed toward the central portion 38 of each of the jaws 34. A plurality of bags 54 is each positioned in the box 50 and is selectively dispensable through the bottom end 52 of the box 50. A selected one of the bags 54 is wrapped around the jaws 34 when the selected bag 54 is removed from the box 50. In this way each of the bags 54 can capture the feces when the jaws 34 are closed around the feces.

In use, the selected bag 54 is drawn outwardly from the bottom end 52 of the box 50 and the selected bag 54 is wrapped upwardly around the central portion 38 of each of the jaws 34. Thus, the selected bag 54 is spread open between the jaws 34 when the jaws 34 are opened. The grip 22 is gripped while walking the domesticated dog and the ring 24 is urged into the opening position to open the jaws 34. Thus, the bag 54 is spread open between the jaws 34 thereby facilitating the bag 54 to be positioned around the feces when the domesticated dog defecates. The ring 24 is released and the bearing 32 biases the jaws 34 to close, thereby facilitating the central portion 38 of each of the jaws 34 to close beneath the feces. In this way the bag 54 is closed around the feces for collection without requiring a user to physically collect the feces. A fresh bag 54 is drawn outwardly from the box 50 and wrapped upwardly around the jaws 34 for further feces collection.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A feces collection assembly being configured to simultaneously retrieve and bag feces, said assembly comprising:

a handle for gripping, said handle being elongated thereby facilitating said handle to extend to ground when said handle is gripped, said handle having a first end and a second end, said handle having a conduit extending through said first and second ends;

a wire being slidably positioned in said conduit, said wire extending outwardly through each of said first and second ends of said handle;

a grip being attached to said handle for enhancing gripping said handle, said grip being positioned on said first end of said handle, said wire extending through said grip;

a ring being movably positioned on said grip, said ring being urgeable between an opening position and a closing position, said wire being coupled to said ring such that said ring urges said wire upwardly in said conduit when said ring is urged into said opening position;

a pair of jaws, each of said jaws being movably positioned on said handle, each of said jaws being operationally coupled to said ring, said pair of jaws opening and closing when said ring is urged between said opening and closing positions wherein said jaws are configured to be positioned around the feces and subsequently close beneath the feces; and a plurality of bags, a selected one of said bags being wrapped around said jaws when said selected bag is removed from a box wherein each of said bags is configured to capture the feces when said jaws are closed around the feces;

a yoke being coupled to said second end of said handle, said yoke having a pair of members being spaced apart from each other and being oriented parallel with an axis extending through said first and second ends of said handle, each of said members having a distal end with respect to said handle, said wire extending through said yoke, said wire having an exposed end with respect to said yoke being positioned between said members;

a bearing being rotatably coupled to said yoke, said bearing extending between said distal end of each of said members of said yoke, said bearing being biased to rotate in a first direction, said bearing being urgeable to rotate in a second direction;

wherein each of said jaws has a pair of bends thereon to define a central portion extending between a first portion and a second portion of said jaws, each of said first and second portions of each of said jaws having a free end, said free end of each of said first and second portions of each of said jaws being coupled to said bearing having said central portion of each of said jaws being spaced from said bearing; and a pair of supports, each of said supports being coupled between said first and second portions of a respective one of said jaws, each of said supports being oriented parallel to said central portion of said respective jaw.

2. The assembly according to claim 1, wherein said central portion of each of said jaws abuts each other when said bearing is biased to rotate in said first direction, said central portion of each of said jaws being spaced apart from each other when said bearing is urged to rotate in said second direction.

3. The assembly according to claim 1, further comprising a pair of fingers, each of said fingers being coupled between said exposed end of said wire and said support on a respective one of said jaws, each of said fingers urging said jaws away from each other when said ring is urged into said opening position, said bearing urging each of said jaws toward each other then said ring is released to move in said closing direction.

4. The assembly according to claim 1, further comprising said box being coupled to said bearing such that said box is positioned between each of said jaws, said box having a bottom end, said bottom end being open, said bottom end being directed toward said central member of each of said jaws.

5. A feces collection assembly being configured to simultaneously retrieve and bag feces, said assembly comprising:

a handle for gripping, said handle being elongated thereby facilitating said handle to extend to ground when said handle is gripped, said handle having a first end and a second end, said handle having a conduit extending through said first and second ends;

a wire being slidably positioned in said conduit, said wire extending outwardly through each of said first and second ends of said handle;

a grip being attached to said handle for enhancing gripping said handle, said grip being positioned on said first end of said handle, said wire extending through said grip;

a ring being movably positioned on said grip, said ring being urgeable between an opening position and a closing position, said wire being coupled to said ring such that said ring urges said wire upwardly in said conduit when said ring is urged into said opening position;

a pair of jaws, each of said jaws being movably positioned on said handle, each of said jaws being operationally coupled to said ring, said pair of jaws opening and closing when said ring is urged between said opening and closing positions wherein said jaws are configured to be positioned around the feces and subsequently close beneath the feces; and a plurality of bags, a selected one of said bags being wrapped around said jaws when said selected bag is removed from a box wherein each of said bags is configured to capture the feces when said jaws are closed around the feces;

a yoke being coupled to said second end of said handle, said yoke having a pair of members being spaced apart from each other and being oriented parallel with an axis extending through said first and second ends of said handle, each of said members having a distal end with respect to said handle, said wire extending through said yoke, said wire having an exposed end with respect to said yoke being positioned between said members;

a bearing being rotatably coupled to said yoke, said bearing extending between said distal end of each of said members of said yoke, said bearing being biased to rotate in a first direction, said bearing being urgeable to rotate in a second direction;

wherein each of said jaws has a pair of bends thereon to define a central portion extending between a first portion and a second portion of said jaws, each of said first and second portions of each of said jaws having a free end, said free end of each of said first and second portions of each of said jaws being coupled to said bearing having said central portion of each of said jaws being spaced from said bearing, said central portion of each of said jaws abuts each other when said bearing is biased to rotate in said first direction, said central portion of each of said jaws being spaced apart from each other when said bearing is urged to rotate in said second direction; and wherein each of said first and second portions of each of said jaws has a curve thereon adjacent to said central portion of said jaws, said first and second portions of each of said jaws angling outwardly from an axis extending through said conduit.

6. A feces collection assembly being configured to simultaneously retrieve and bag feces, said assembly comprising:

a handle for gripping, said handle being elongated thereby facilitating said handle to extend to ground when said handle is gripped, said handle having a first end and a second end, said handle having a conduit extending through said first and second ends;

a wire being slidably positioned in said conduit, said wire extending outwardly through each of said first and second ends of said handle;

a grip being attached to said handle for enhancing gripping said handle, said grip being positioned on said first end of said handle, said wire extending through said grip;

a ring being movably positioned on said grip, said ring being urgeable between an opening position and a closing position, said wire being coupled to said ring such that said ring urges said wire upwardly in said conduit when said ring is urged into said opening position;

a yoke being coupled to said second end of said handle, said yoke having a pair of members being spaced apart from each other and being oriented parallel with an axis extending through said first and second ends of said handle, each of said members having a distal end with respect to said handle, said wire extending through said yoke, said wire having an exposed end with respect to said yoke being positioned between said members;

a bearing being rotatably coupled to said yoke, said bearing extending between said distal end of each of said members of said yoke, said bearing being biased to rotate in a first direction, said bearing being urgeable to rotate in a second direction;

a pair of jaws, each of said jaws being movably positioned on said handle wherein said jaws are configured to manipulate feces on the ground, each of said jaws being operationally coupled to said ring, said pair of jaws opening and closing when said ring is urged between said opening and closing positions wherein said jaws are configured to be positioned around the feces and subsequently close beneath the feces, each of said jaws having a pair of bends thereon to define a central portion extending between a first portion and a second portion of said jaws, each of said first and second portions of each of said jaws having a free end, said free end of each of said first and second portions of each of said jaws being coupled to said bearing having said central portion of each of said jaws being spaced from said bearing, said central portion of each of said jaws abutting each other when said bearing is biased to rotate in said first direction, said central portion of each of said jaws being spaced apart from each other when said bearing is urged to rotate in said second direction, each of said first and second portions of each of said jaws having a curve thereon adjacent to said central portion of said jaws, said first and second portions of each of said jaws angling outwardly from an axis extending through said conduit;

a pair of supports, each of said supports being coupled between said first and second portions of a respective one of said jaws, each of said supports being oriented parallel to said central portion of said respective jaw, a pair of fingers, each of said fingers being coupled between said exposed end of said wire and said support on a respective one of said jaws, each of said fingers urging said jaws away from each other when said ring is urged into said opening position, said bearing urging each of said jaws toward each other then said ring is released to move in said closing direction;

a box being coupled to said bearing such that said box is positioned between each of said jaws, said box having a bottom end, said bottom end being open, said bottom end being directed toward said central member of each of said jaws; and a plurality of bags, each of said bags being positioned in said box and being selectively dispensable through said bottom end of said box, a selected one of said bags being wrapped around said jaws when said selected bag is removed from said box wherein each of said bags is configured to capture the feces when said jaws are closed around the feces, said selected bag being wrapped upwardly around said central portion of each of said jaws such that said selected bag is spread open between said jaws when said jaws are opened.

* * * * *